US005089828A

United States Patent [19]

Moss

[11] Patent Number: 5,089,828

[45] Date of Patent: Feb. 18, 1992

[54] ELECTROMAGNETIC RADIATION RECEIVER

[75] Inventor: Graham H. Moss, Stevenage, United Kingdom

[73] Assignee: British Aerospace Public Limited Company, London, England

[21] Appl. No.: 218,114

[22] Filed: Jun. 29, 1988

[30] Foreign Application Priority Data

Jul. 2, 1987 [GB] United Kingdom ..... 8715531

[51] Int. Cl.[5] ..... H01Q 21/00; H01Q 15/02

[52] U.S. Cl. ..... 343/725; 343/909

[58] Field of Search ..... 343/725, 909, 911 R; 342/351; 244/3.16

[56] References Cited

U.S. PATENT DOCUMENTS 3,287,728 11/1966 Atlass ..... 343/753

4,636,797 1/1987 Saffold et al. ..... 343/781 CA

FOREIGN PATENT DOCUMENTS 0262590 9/1987 European Pat. Off. .

0281042 2/1988 European Pat. Off. .

WO87/02193 4/1987 PCT Int'l Appl. .

*Primary Examiner*—Gregory C. Issing

*Attorney, Agent, or Firm*—Nixon & Vanderhye

[57] ABSTRACT

A common aperture, dual mode receiver for receiving and sensing radiation in the infra-red and microwave waveband comprises an input lens 1, a beamsplitter 2 which deflects microwave radiation and passes infra-red radiation to a microwave focussing sub-system (7, 8) and an infra-red focussing sub-system (3, 4, 5) respectively. The microwave sub-system includes an array of integrated antenna/mixer circuits positioned on the rear surface of the final lens 8.

11 Claims, 1 Drawing Sheet

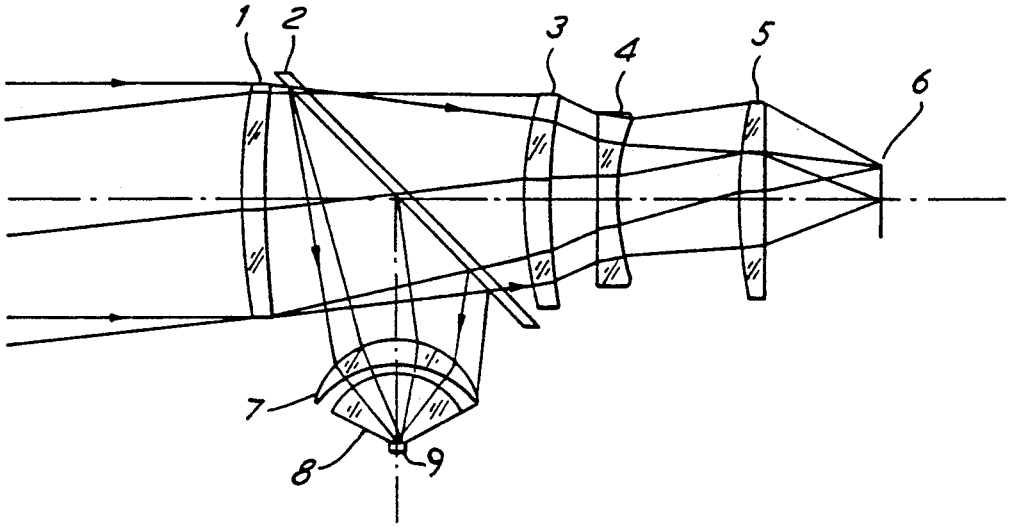
1
2
3
4
5
6
7
8
9

ELECTROMAGNETIC RADIATION RECEIVER

FIELD OF THE INVENTION

This invention relates to apparatus for simultaneously receiving and sensing electromagnetic radiation in both the infra-red and millimetric wavebands.

BACKGROUND OF THE INVENTION

A need exists for such types of systems in military sensor systems, such as missile guidance and surveillance, where a wide band of operating wavelengths will provide operational advantage and improved performance.

In my earlier U.S. patent application Ser. No. 933,195, filed Nov. 19th 1986, and abandoned Sep. 27, 1989, naming A. P. Wood as co-applicant and assigned to the assignee of the present invention, I disclose a catadioptric system for allowing simultaneous reception of infra-red and millimetric radiation through a common aperture. However, the catadioptric arrangement results in some aperture blockage.

SUMMARY OF THE INVENTION

According to this invention, there is provided apparatus for simultaneously receiving and sensing electromagnetic radiation in the infra-red and millimetric wavebands, the apparatus comprising:

aperture means for receiving and transmitting therethrough said radiation;

beamsplitter means for receiving said radiation from the aperture means, for transmitting one of the infra-red component and the millimetric component of said radiation and for deflecting the other component;

an infra-red radiation focussing sub-system positioned for receiving said infra-red component from the beamsplitter means and for imaging the component at a focal plane;

a millimetric sub-system for receiving said millimetric component from the beamsplitter means and imaging it onto an array.

BRIEF DESCRIPTION OF THE DRAWING

A non-limiting example of the invention will now be described with reference to the accompanying drawing which is a side view of part of a dual waveband sensor system.

DETAILED DESCRIPTION OF PREFERRED EMBODIMENT

The system disclosed and illustrated herein combines two areas of detector technology. For the microwave system an integrated antenna/mixer circuit array (a MARS array) is utilised in the microwave image plane. This device typically may operate in the 35–95 GHz region. The device requires a medium in contact with it which has the same dielectric constant as the device substrate, therefore there is no air gap between the final lens and the device. Radiation may be injected onto the array either from the front or the rear, either directly or via a suitable beamsplitter.

The disclosed system consists of two optical systems which are combined by use of a beamsplitter. Both systems view the same scene through a common window.

The infra-red sub-system utilises infra-red optical materials, e.g. Germanium and Zinc Sulphide, to image the radiation onto a suitable infra-red detector, e.g. a quadrant detector array. The sub-system can operate in either monochromatic mode for laser detection, or cover a finite waveband e.g. 8–12 microns, for thermal imaging.

The microwave sub-system utilises microwave transmitting materials with a low loss tangent, e.g. Alumina, to image the radiation onto the MARS array. The MARS array is located on the final surface of the imaging lens.

The common optical aperture precedes the two sub-systems described above. It utilises a Zinc Sulphide refracting element which transmits both microwave and infra-red radiation. The radiation is directed into the two sub-assemblies by a beamsplitter, which reflects the microwave radiation and transmits the infra-red radiation. This could be made from an infra-red transmitting semiconductor, e.g. Germanium, or a fine metal mesh, or a dielectric stack.

Referring now to the Figure, element 1 is a microwave/infra-red transmitting lens which provides a common aperture for the subsequent sub-systems. The lens also has power and therefore forms a common front end to both of the following sub-systems. Element 2 is the beamsplitter. Microwave radiation is reflected to the microwave lenses (7, 8), while infra-red radiation is transmitted to the infra-red optics (3, 4, 5).

The image plane for the microwave sub-system is located on the rear of element 8, while the image plane 6 for the infra-red sub-system is located in free space to the rear of element 5. As mentioned above, the microwave detector comprises an integrated antenna/mixer circuit array 9 attached to the rear surface of the dielectric lens 8, at the image plane thereof. Each antenna/-mixer circuit comprises a pair of crossed dipoles interconnected via diodes. In each case, one of the dipole pairs is responsive to linearly polarised radiation received via the dielectric lens 8 while the other dipole pair is responsive to orthogonally polarised local oscillator radiation which it receives. The local oscillator signal for the microwave sub-system may be injected in the rear of element 8. Elements 1 and 7 are Zinc Sulphide lenses with spherical surfaces. Elements 3 and 5 are Germanium lenses with spherical surfaces and element 4 is a Zinc Sulphide lens with spherical surfaces. Element 8 is an Alumina lens with an aspheric surface profile. Element 2 is a thin Germanium plate with flat surfaces, located at 45 degrees to the axis. All the optical elements may be coated with suitable dielectric layers to improve transmission.

Embodiments of this invention provide a compact, lightweight imaging system which operates in both the microwave and infra-red wavelengths. Embodiments of the invention are unique in that they operate in both wavebands simultaneously, and do not include any aperture blockage inherent in catadioptric designs. In addition, a common input aperture is used which significantly reduces the size of the system. This makes the system less obtrusive and reduces the risk of external detection. The common aperture also minimises the system's susceptibility to boresight errors.

What is claimed is:

1. Apparatus for simultaneously receiving and sensing electromagnetic radiation in the infra-red and millimetric wavebands, the apparatus comprising:

aperture means for receiving and transmitting therethrough said radiation;

beamsplitter means for receiving said radiation from the aperture means, for transmitting one of the infra-red component and the millimetric component of said radiation and for deflecting the other component;

an infra-red radiation focussing sub-system means for receiving said infra-red component from the beamsplitter means and for imaging said infra-red component at a focal plane;

a millimetric sub-system means for receiving said millimetric component from the beamsplitter means said millimetric sub-system means comprising a dielectric lens means having front and rear surfaces, and an array of integrated antenna/mixer circuits located on said rear surface, said dielectric lens means including an aspheric surface profile on said front surface comprising means for receiving said millimetric component at said front surface and for imaging said millimetric component on said array on said rear surface.

2. Apparatus according to claim 1, which further comprises an input lens means for receiving and transmitting therethrough said radiation.

3. Apparatus according to claim 1, wherein said beamsplitter means transmits the infra-red component and deflects the millimetric component.

4. Apparatus according to claim 2, wherein said beamsplitter means is made from an infra-red transmitting semiconductor.

5. Apparatus according to claim 3, wherein said beamsplitter means is made from a fine metal mesh.

6. Apparatus according to claim 3, wherein said beamsplitter means is made from a dielectric stack.

7. Apparatus according to claim 3, wherein said input lens comprises a Zinc Sulphide refracting element.

8. Apparatus according to claim 1, wherein the infra-red focussing sub-system comprises a plurality of lens means each made of one of Germanium and Zinc Sulphide.

9. Apparatus according to claim 1, wherein the dielectric lens means is formed of Alumina.

10. Apparatus according to claim 1, wherein each integrated antenna/mixer circuit comprises a pair of crossed dipoles, one of the pair being responsive to linearly polarised radiation received via the dielectric lens means, the other of the pair being responsive to linearly polarised local oscillator radiation.

11. Apparatus for simultaneously receiving and sensing electromagnetic radiation in the infra-red and millimetric wavebands, the apparatus comprising:

aperture means for receiving and transmitting therethrough said radiation;

beamsplitter means for receiving said radiation from the aperture means, for transmitting one of the infra-red component and the millimetric component of said radiation and for deflecting the other component;

an infra-red radiation focussing sub-system means for receiving said infra-red component from the beamsplitter means and for imaging said infra-red component at a focal plane, and an array of integrated antenna/mixer circuits responsive to said millimetric component;

a millimetric sub-system means for receiving said millimetric component from the beamsplitter means, and for imaging said millimetric component onto said array, wherein the infra-red radiation focussing sub-system means and the millimetric sub-system means have respective radiation paths generally orthogonal with respect to each other and said array is located on said millimetric sub-system means.

* * * * *